US006698699B1

(12) United States Patent
Bailey

(10) Patent No.: US 6,698,699 B1
(45) Date of Patent: Mar. 2, 2004

(54) WORKING MATERIAL RETAINING ACCESSORY

(76) Inventor: Raymond B. Bailey, 2845 Harvey St., La Crosse, WI (US) 54603

( * ) Notice: Subject to any disclaimer, the term of this patent is extended or adjusted under 35 U.S.C. 154(b) by 0 days.

(21) Appl. No.: 10/236,393

(22) Filed: Sep. 5, 2002

Related U.S. Application Data

(60) Provisional application No. 60/322,110, filed on Sep. 13, 2001.

(51) Int. Cl.[7] ..... E06C 7/14

(52) U.S. Cl. ..... 248/210; 248/231.61; 248/231.85; 248/238; 248/310; 248/205.8; 182/129

(58) Field of Search ..... 248/210, 238, 248/205.2, 231.21, 231.6, 231.85, 310; 182/129

(56) References Cited

U.S. PATENT DOCUMENTS

| | | | | | |
|---|---|---|---|---|---|
| 2,473,951 | A | * | 6/1949 | Hickey | 182/120 |
| 2,982,982 | A | * | 5/1961 | Swift | 15/257.06 |
| 3,053,494 | A | * | 9/1962 | Stoll | 248/228.3 |
| 3,317,171 | A | * | 5/1967 | Kramer | 248/229.15 |
| 3,576,045 | A | * | 4/1971 | Stafford | 15/257.06 |
| 3,979,097 | A | | 9/1976 | Balne | |
| 3,987,993 | A | * | 10/1976 | Hopkins | 248/210 |
| 4,013,251 | A | | 3/1977 | Cleveland | |
| 4,036,463 | A | * | 7/1977 | Hopkins et al. | 248/210 |
| 4,245,807 | A | | 1/1981 | York | |
| 4,550,803 | A | | 11/1985 | Finster et al. | |
| 4,560,127 | A | | 12/1985 | Ippolito | |
| 4,577,820 | A | | 3/1986 | Michaud | |
| 4,589,521 | A | | 5/1986 | Finster et al. | |
| 4,776,550 | A | | 10/1988 | Storey | |
| 4,815,684 | A | | 3/1989 | Kellstadt | |
| 4,874,147 | A | * | 10/1989 | Ory et al. | 248/210 |
| 4,962,906 | A | | 10/1990 | Fatool et al. | |
| D312,158 | S | | 11/1990 | Lund | |
| 4,998,696 | A | | 3/1991 | Desjardins | |
| D316,809 | S | | 5/1991 | Carson | |
| 5,085,390 | A | | 2/1992 | Murphy | |
| 5,098,052 | A | * | 3/1992 | Beck | 248/238 |
| 5,123,620 | A | | 6/1992 | Bourne | |
| 5,145,226 | A | | 9/1992 | LaFontaine | |
| 5,316,251 | A | | 5/1994 | McGraw | |

(List continued on next page.)

*Primary Examiner*—Ramon O. Ramirez
*Assistant Examiner*—Amy J. Sterling
(74) *Attorney, Agent, or Firm*—M. Paul Hendrickson

(57) ABSTRACT

Working material containers such as paint cans may be effectively stabilized from accidental dislodgment from a ladder shelf, such as a step ladder shelf, through the use of a working material container accessory. The accessory includes a flat upper support plate placed onto the top shelf surface and a lower retaining plate positioned below the shelf surface securely bolted together onto the step ladder shelf. By adhesively applying a strip of the looped member of a hook and loop fastening system to a paint container bottom and another mating hook strip onto the upper surface of the upper support plate, the paint container may be securely retained and stabilized upon the ladder shelf against accidental dislodgment or spillage. The paint container may be easily removed simply by unfastening the hook and loop straps for one another.

3 Claims, 2 Drawing Sheets

U.S. PATENT DOCUMENTS 5,390,888 A 2/1995 Rogers
5,413,296 A 5/1995 LaFontaine
5,509,169 A 4/1996 Drucker
5,511,753 A 4/1996 Lage
5,515,573 A * 5/1996 Frey ..... 15/327.2
5,542,553 A 8/1996 Penniman
5,584,453 A 12/1996 Morter
5,636,817 A * 6/1997 Beachy ..... 248/210
5,673,885 A * 10/1997 Pham ..... 248/210
5,687,941 A 11/1997 Quintile
5,775,651 A 7/1998 Jackovich
5,845,742 A 12/1998 Tade et al.
5,873,433 A 2/1999 Katz
5,873,486 A * 2/1999 Morgan ..... 220/739
5,899,296 A * 5/1999 Lantz ..... 182/214
6,006,966 A 12/1999 Voisin, Jr.
6,076,636 A 6/2000 Tietge
6,148,958 A 11/2000 Ahl et al.
6,286,798 B1 * 9/2001 Chun ..... 248/311.2
6,341,666 B1 * 1/2002 Allen ..... 182/129
6,443,260 B1 * 9/2002 Katz et al. ..... 182/129

* cited by examiner

WORKING MATERIAL RETAINING ACCESSORY

This application is a non-provisional application of earlier filed provisional application 60/322,110 entitled "Working Material Retaining Accessory", filed on behalf of Raymond B. Bailey on Sep. 13, 2001.

FIELD OF INVENTION

The present invention relates to a container retaining accessory and more particularly to an accessory for securely retaining working containers such as paint containers to shelved ladders, the combination therewith and its use.

BACKGROUND OF THE INVENTION

There exists a need for an accessory which can tenaciously retain a working material container to a shelf of a ladder. Such a need is exemplified by the placement of paint containers upon the shelves of ladders such as top shelved rung or a pivotally mounted shelf tray of step ladders. Under normal working conditions, a sudden jarring motion against the ladder frequently results in an unwanted spilling of the paint. This can cause considerable damage to the work area and result in considerable lost time and effort to clean up the paint spill.

If there existed a retaining means to securely retain the paint container to the shelved members of ladders and to avoid unwanted spillage, accidental paint spillages could be alleviated. Unfortunately, the surface of the shelved members of ladders are generally unfit for securely retaining the paint containers under the typical working conditions. The paint containers are susceptible to jarring and dislodgment from the shelved member.

It has been found that paint containers may be tenaciously retained to the upper surface of a ladder shelf with a paint container retaining accessory. The accessory may be readily attached to paint container and the ladder shelf to secure the paint container thereto and stabilizes the retained paint container from tipping and spillage.

SUMMARY OF THE INVENTION

Working material containers such as paint cans may be stabilized against accidental dislodgment from a ladder shelf with a working material container accessory. The accessory is particularly beneficial for securing paint containers to shelved members of step ladders. The accessory includes a flat upper support plate and a bottom retaining plate and detachable retaining means for securely sandwiching the upper support plate and the bottom retaining plate onto the ladder shelf. By adhesively applying a hooked fastener strip and napped fastener strip to a bottom side of paint container and the upper support plate in an interfacial engaging relationship, the paint container may be securely retained upon the ladder shelf and stabilized from unwanted or accidental dislodgment and spillage.

DETAILED DESCRIPTION OF THE INVENTION

Figure 1:
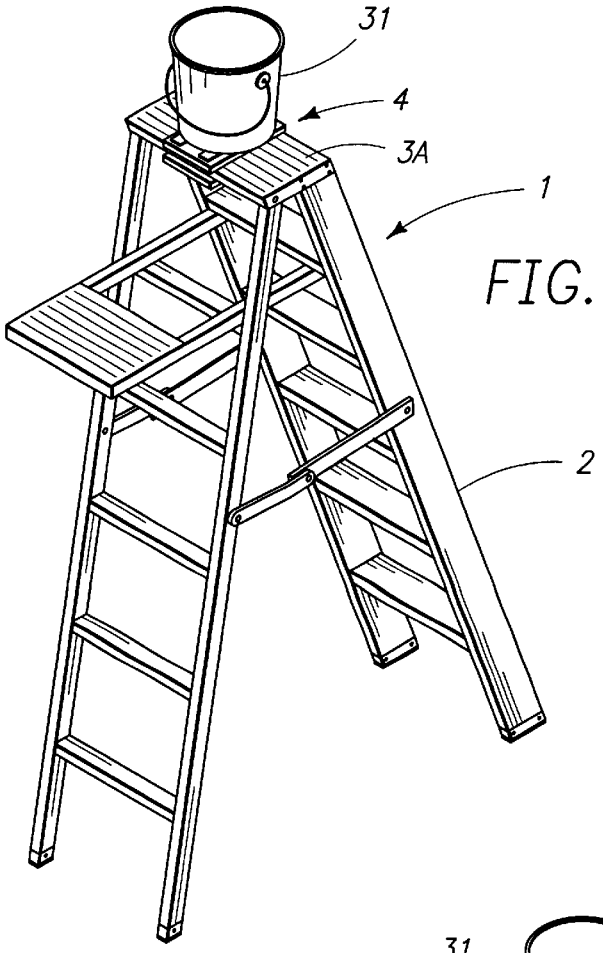
FIG. 1 is a prospective view of a paint container securely retained to a top step of a conventional step ladder with a retaining accessory of this invention.
Figure 2:
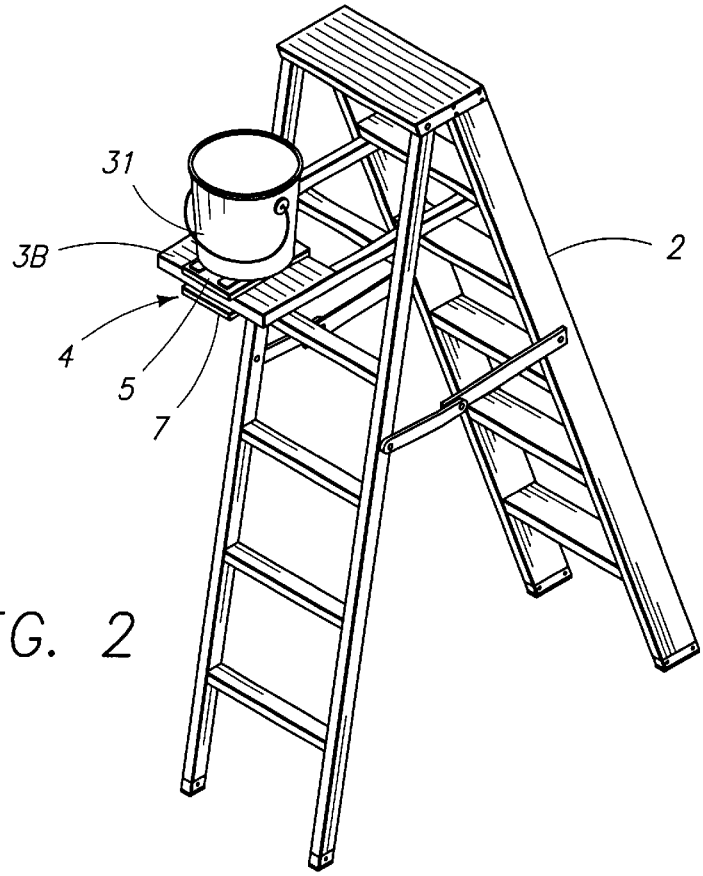
FIG. 2 is a prospective view of the retaining accessory mounted to a holding tray of a conventional step ladder as shown in FIG. 1.
Figure 3:
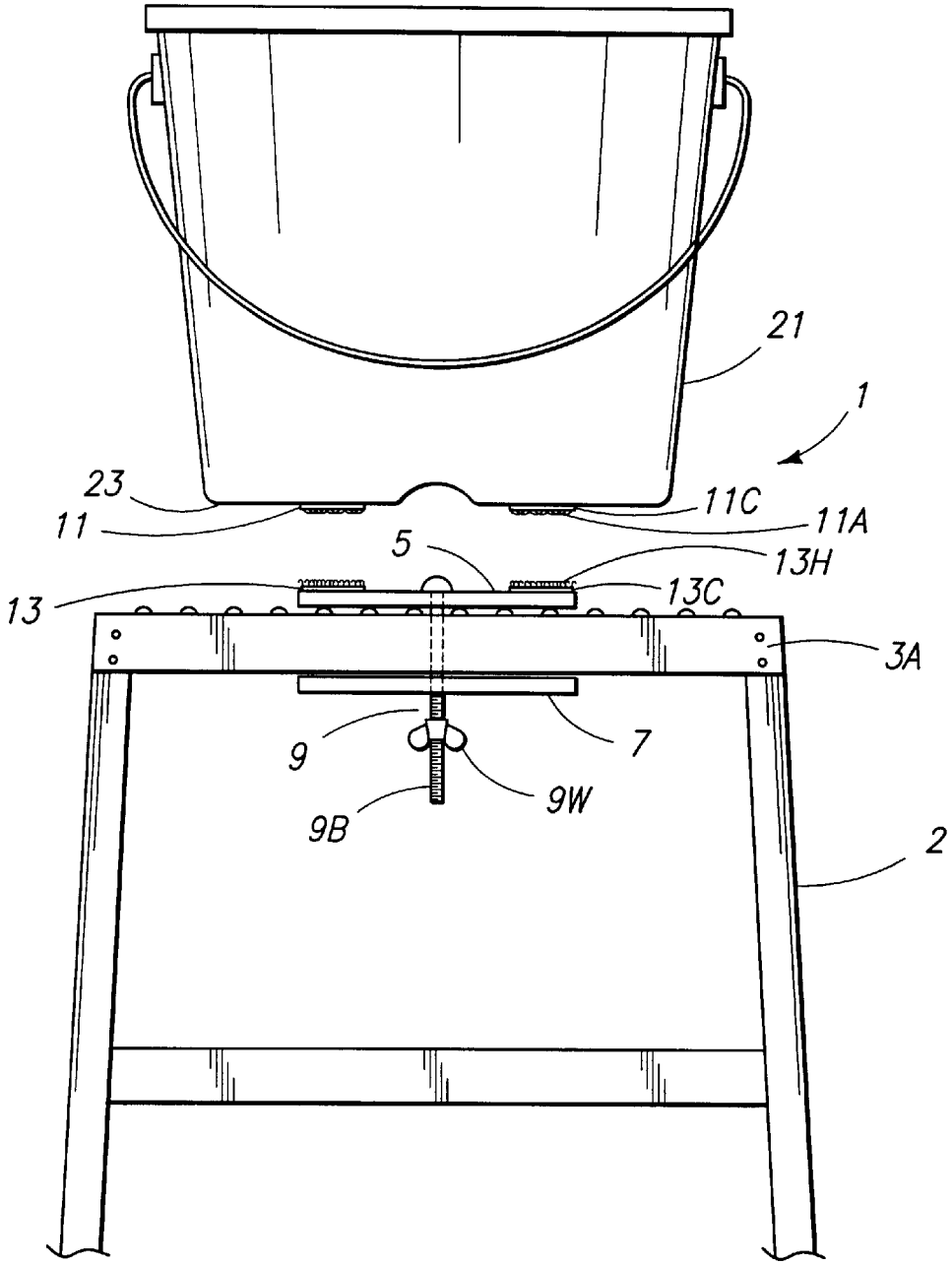
FIG. 3 is magnified rear view depicting the paint container disengaged from the retaining accessory shown in FIG. 1.

Pursuant to the present invention, there is provided a combination (generally designated as I) comprised of a working material paint container 21 such as the shown paint container having a flat bottom side 33, a ladder 2 equipped with a flat shelf (generally prefixed by 3 such as the top shelved step 3A of FIG. 1 or the shelved tray 3B of FIG. 2) for retaining working materials 31 such as the paint container thereupon and a working material retainer (generally referenced as 4) for securely retaining the working materials container 31 onto shelf 3. As illustrated in FIGS. 1 and 2, the retainer 4 is particularly adapted for retaining a paint container 31 to the shelved top 3A or step surface 3B. The retaining accessory 4 includes a flat upper support plate 5 secured upon shelved surface 3 of ladder 2 and a lower retaining plate 7 secured beneath shelved surface 3 and detachable retaining means (generally designated as 9) shown as bolt 9B and wing nut 9W for retaining the upper support plate 5 and the bottom retaining plate 7 securely to shelf 3. Retaining accessory 4 includes both a paired hooked fastener strip (prefixed by 13) and a mating pair of looped fastener strips (prefixed by 11) comprised of an engaging napped or looped strip material 11B filled with an oppositely positioned facing adhesively backing (depicted as 11C) for adhesively securing the engaging looped strip to the bottom side 23 of paint container 21 or alternatively to upper plate 5. The hooked fastener strips 13 are comprised of a series of rowed hooked fasteners 13H on one strip side for hooking and engaging onto the loops 11B of strips 11 and an adhesively backing member 13C on the opposite side from the hooked fasteners 13H for adhesively securing the hooked strips 13 to upper plate 5 oppositely of looped material 11.

The looped strip 11 and the hooked strip 13 may be interchangeably placed upon either the upper plate 5 or the flat bottom side 23 of container 21. Hooked strip 13 typically comprises a conventional hooked nylon fabric material having a series of spiral nylon hooks 13H supported by fiber strip backing 13F and an adhesive coating 13 secured on the opposite side, so as to secure strip 13 to the upper retaining plate 5. The adhesive backings 11C and 13C of material 11B and hooked material 13 are typically provided in a commercial form by a strippable plastic strip (not shown). In general, the hooked material 13 useful in this invention is derived from preshrunk nylon filaments having sufficient rigidity within the individual hooks to permit the hooks to penetrate the pile of napped material 11B rigidity to maintain hooks 13H in a hooking position and thereby retain the paint container 21 thereupon. In general, the effective hook materials 13 utilized herein are constructed of monofilament nylon hooks to possess the necessary properties so as to securely maintain the paint container 21 thereupon.

Stability of paint container 21 against tipping or spilling is enhanced by providing at least two laterally positioned hooked material strips 13 and looped material strips 11 at an interfacial relationship as shown in the Figures. This may be effectuated by placing two parallel napped strips 11 on the bottom side 23 of container 13 with two mating strips of hooked material 13 being correspondingly positioned to top plate 5.

What is claimed is:

1. In a combination comprised of a paint container having a flat bottom side, a ladder equipped with a shelf for placing the paint container thereupon, a paint container retainer for securely retaining the paint container onto said shelf, said paint retainer consisting essentially of a flat upper support plate secured to top side of the shelf, a bottom retaining plate secured to beneath the shelf and detachable retaining means for retaining the upper support plate and the bottom retaining plate securely to the shelf, and at least two laterally positioned mating strips of a hooked and looped fastener material adhesively emplaced onto the flat bottom side of the paint container and the flat upper support plate in an interfacing position so that the hooked and looped material tenaciously secures the paint container onto said shelf when interfacially engaged onto one another.

2. A retaining accessory for retaining working containers to a shelved member of a ladder, said retaining accessory consisting essentially of a flat upper support plate for securance onto the shelved member, a bottom plate for securance beneath the shelved member, a detachable retaining unit for securing the bottom plate and the upper support plate to the shelf and at least two laterally positioned mating strips of a hooked and looped fastener material for adhesive emplacement onto a bottom side of the working container and an upper surface portion of the upper retaining plate.

3. A method for retaining a working container to a shelved member of a ladder. Said method consisting essentially of:

a) securing between the shelved member a flat upper support plate and a bottom plate;

b) adhesively applying at least two laterally positioned mating strips of a hooked fastener strip and a napped fastener strip secured to the upper support plate and a bottom side of the working container in a mating interfacing relationship, and c) matingly engaging together the hooked fastener stripe and the napped fastener strips so as to securely retain the working container to the upper support plate.

* * * * *